US005988435A

United States Patent [19]

Edwards et al.

[11] Patent Number: 5,988,435

[45] Date of Patent: Nov. 23, 1999

[54] FLUID DISPENSING SYSTEM

[75] Inventors: James R. Edwards; Chester E. Chomka, both of Dubuque, Iowa; Lawrence J. Fenske, Oregon, Wis.; Kerry W. Leppert; Charles T. Nachtman, both of Dubuque, Iowa

[73] Assignee: Barnstead/Thermolyne Corporation, Dubuque, Iowa

[21] Appl. No.: 08/890,048

[22] Filed: Jul. 9, 1997

[51] Int. Cl.[6] ..... B67B 7/00

[52] U.S. Cl. ..... 222/1; 222/318; 222/474

[58] Field of Search ..... 222/1, 144.5, 318, 222/474, 475; 422/100

[56] References Cited

U.S. PATENT DOCUMENTS 3,885,713 5/1975 Weitzel et al. ..... 222/474 X
5,817,231 10/1998 Souza ..... 210/96.2

OTHER PUBLICATIONS

Milli–Q® Ultrapure Water Systems Advertisement, Laboratory Equipment, Feb. 1997.

Marty Burkhart, et al., Leaching Characteristics of Polyvinylidene Fluoride and Polypropylene, pp. 30–34, Ultrapure Water, May/Jun. 1997.

*Primary Examiner*—Gregory L. Huson

*Attorney, Agent, or Firm*—Wood, Herron & Evans, L.L.P.

[57] ABSTRACT

A manually operable fluid dispensing system having a fluid dispenser connected to a fluid source by flexible tubing. The dispensing system provides a supply fluid path from the source of fluid to the dispenser and a recirculation fluid path from the dispenser to the source of fluid. A dispenser mount is rigidly attached to a support surface for releasably holding the dispenser, and the dispenser mount supports the dispenser in a fixed position for dispensing fluid therefrom. In addition, the dispenser can be removed from the mount for dispensing fluid at a remote location. A manually operable trigger is pivotally connected to the dispensing valve and has a quiescent position which closes the dispensing valve. When in the quiescent position, a trigger handle extends over an exterior portion of the dispenser body in a generally forward direction toward the dispensing outlet and forms an included angle with the dispenser body. The trigger is movable toward the dispenser body to open the dispensing valve, thereby permitting fluid to flow through the dispensing outlet. A spring biases the trigger handle toward its quiescent position, thereby closing the dispensing valve and stopping the flow of fluid through the dispensing outlet.

43 Claims, 5 Drawing Sheets

FLUID DISPENSING SYSTEM

FIELD OF THE INVENTION

This invention relates to fluid dispensing and more particularly, to a manual fluid dispensing system having improved dispensing capabilities.

BACKGROUND OF THE INVENTION

Self-contained water purifiers have been available for decades and principally are used in laboratory environments to provide highly purified, for example, ultra pure, reagent water. The highest quality reagent water conforms to or exceeds ASTM Type I standards which require water having a specific resistance of greater than 18.0 megohm-cm and a total organic carbon (TOC) content of no more than 100 parts per billion (ppb). Such water purifiers are normally connected to a water source which may, or may not, provide pretreatment. Further, the water purifiers have a manually operable dispensing valve fixed at a convenient location, for example, on a forward surface of the water purifier. When applications dictate the need for a capability of dispensing liquid remote from the purifier, in addition to a normal dispenser, a separate and independent dispenser is connected to the water purifier by means of flexible tubing. Therefore, to obtain the benefits of the capability of remote dispensing, a separate, redundant, manually operable dispenser is used. The additional dispenser not only substantially increases the cost of the system, but provides an additional potential source of water contamination from the surfaces required by the second dispensing valve. Therefore, such purifiers have the disadvantages of increased costs, as well as a reduced efficiency in removing contaminants to compensate for the additional impurities introduced by the remote dispenser.

Prior remote dispensers generally fall into one of two categories. A first category includes generally pistol-shaped dispensers in which the grip element is approximately perpendicular to the centerline of the dispensing outlet. Such dispensers are most conveniently used when fluid is to be dispensed in a stream or a spray at a relatively low elevation, for example, from hip level. However, in a laboratory, such pistol-shaped dispensers are more difficult to use when filling a container being held up at eye level in front of a user. For example, a flask having graduations on its side is most conveniently held approximately at head level so that the user may observe the flask graduations as fluid is being filled therein. Utilizing a pistol-shaped dispenser in such an application requires an awkward bending of the wrist, which makes precise operation of the trigger very difficult.

A second category of dispenser includes designs in which the grip is more in line with the dispenser outlet and forms an obtuse angle with the centerline of the dispenser outlet. Those dispensers also conveniently dispense fluid to be dispensed into a container at a lower elevation. In addition, the shape of those dispensers permits them to be grasped at a position forward of the dispensing control and held upside down for filling flasks that are of a higher elevation, generally at the eye level of the user. However, the dispensers are relatively large and bulky and not conveniently gripped by users having smaller hands. Therefore, it is possible to differently grip the second category of dispensers for different dispensing applications, their larger size makes such use awkward and hard to control.

Normally, remote dispensers have a recirculation capability, that is, when the dispensing outlet is closed, fluid continually recirculates through the dispenser so that any impurities leaching into the water are flushed away on a continuing basis. Consequently, the purifier remains in an "at ready" state to dispense reagent water. The designs of prior dispensers often permit a small quantity of water to reside between the dispensing valve and the point of use dispensing outlet, thereby avoiding the recirculation path. Consequently, over a period of time, for example, overnight, that non-recirculating, stationary water will often leach material from the dispenser components and, will further begin to stagnate and promote the growth of bacteria. In that situation, the fixed dispenser must be used until the remote dispenser can be cleaned, for example, by dousing in a bleach solution to rid it of the bacteria. Therefore, there is a need for an improved dispensing system to overcome the problems described above.

SUMMARY OF THE INVENTION

The present invention provides a fluid dispensing system in which a single dispenser is capable of dispensing water at both fixed and remote locations. Further, the fluid dispenser of the present dispensing system is ergonomically designed and shaped for a user's hand so that the dispenser may be comfortably held and easily used in a variety of positions, including at eye level, to facilitate different dispensing postures. In addition, the fluid dispenser of the present invention is designed to minimize leaching of dispenser component materials into the water as well as minimize nonrecirculating water, thereby minimizing the potential for bacteria growth. Consequently, the potential of unnecessarily imparting impurities into the fluid is minimized. Therefore, the fluid dispenser of the present invention is especially useful in laboratory environments in which reagent water is dispensed into containers of different sizes and at different elevations.

According to the principles of the present invention and in accordance with the preferred embodiments, a manually operable fluid dispensing system includes a source of fluid which is connected by flexible tubing to a dispenser having a manually operable dispensing valve. The dispensing system provides a supply fluid path from the source of fluid to the dispenser and a recirculation fluid path from the dispenser to the source of fluid. A dispenser mount is rigidly attached to a support surface for releasably holding the dispenser, and the dispenser mount supports the dispenser in a fixed position for dispensing fluid therefrom. In addition, the dispenser can be removed from the mount for dispensing fluid at a remote location. By using a single dispenser with a single dispensing valve for both fixed and remote dispensing, the fluid dispensing system of the present invention minimizes the potential for introducing impurities from dispenser components into the fluid. Therefore, after periods of nonuse, the water can be polished for use in minimal time.

In another embodiment of the invention, the fluid dispensing system includes a dispensing valve having a valve body with a fluid inlet, a fluid dispensing outlet at one end of the valve body, a valve seat between the inlet and the dispensing outlet, and a fluid recirculation outlet. A valve is slidably mounted within the valve body and provides a recirculation fluid path providing fluid communication between the inlet and the recirculation outlet. The valve further includes a valve tip engageable with the valve seat to provide a fluid seal. The valve tip is selectively movable to a first position sealingly engaging the valve seat and providing a recirculation fluid path between the inlet and the recirculation outlet. The valve tip is also selectively movable to a second position away from the valve seat to provide a fluid path from the inlet to the dispensing outlet. When in the second position, the valve tip partially covers the recirculation outlet to inhibit the flow of fluid therethrough.

In one aspect of the invention, the inlet, recirculation outlet and the dispensing outlet are located immediately adjacent the valve seat, and the recirculation fluid path is provide by an annular groove in the valve. Further, the valve includes a land adjacent the annular groove that partially blocks the recirculation passage when the valve is open. The above design minimizes the areas in the valve that are wetted by the fluid and thus, minimizes the opportunity for impurities to leach from valve components into the fluid as well as minimize bacteria growth. Therefore, in reagent grade water applications, the present invention has a further advantage of minimizing the time required to polish the water to the desired reagent water specifications.

In another embodiment of the invention, the fluid dispensing system includes a generally elongated dispenser body having a forward surface connecting forward common edges of two lateral sides and a lower side. A dispensing valve connected to a source of fluid is mounted within the dispenser body and has a dispensing outlet extending through the forward surface and angles downward toward the lower side of the body. A manually operable trigger is pivotally connected to the dispensing valve and has a quiescent position which closes the dispensing valve. When in the quiescent position, a trigger handle extends over an exterior portion of the dispenser body in a generally forward direction toward the dispensing outlet and forms an included angle with the dispenser body. The trigger is movable toward the dispenser body to open the dispensing valve, thereby permitting fluid to flow through the dispensing outlet. A spring biases the trigger handle toward its quiescent position, thereby closing the dispensing valve and stopping the flow of fluid through the dispensing outlet. The ergonomic design of the fluid dispenser permits the dispenser to be comfortably held and easily used in a variety of positions to facilitate different dispensing postures. Thus, the dispensing system has the advantage of being able to easily dispense fluid into any size container at any elevation.

These and other objects and advantages of the present invention will become more readily apparent during the following detailed description taken in conjunction with the drawings herein.

DETAILED DESCRIPTION OF THE INVENTION

Figure 1:
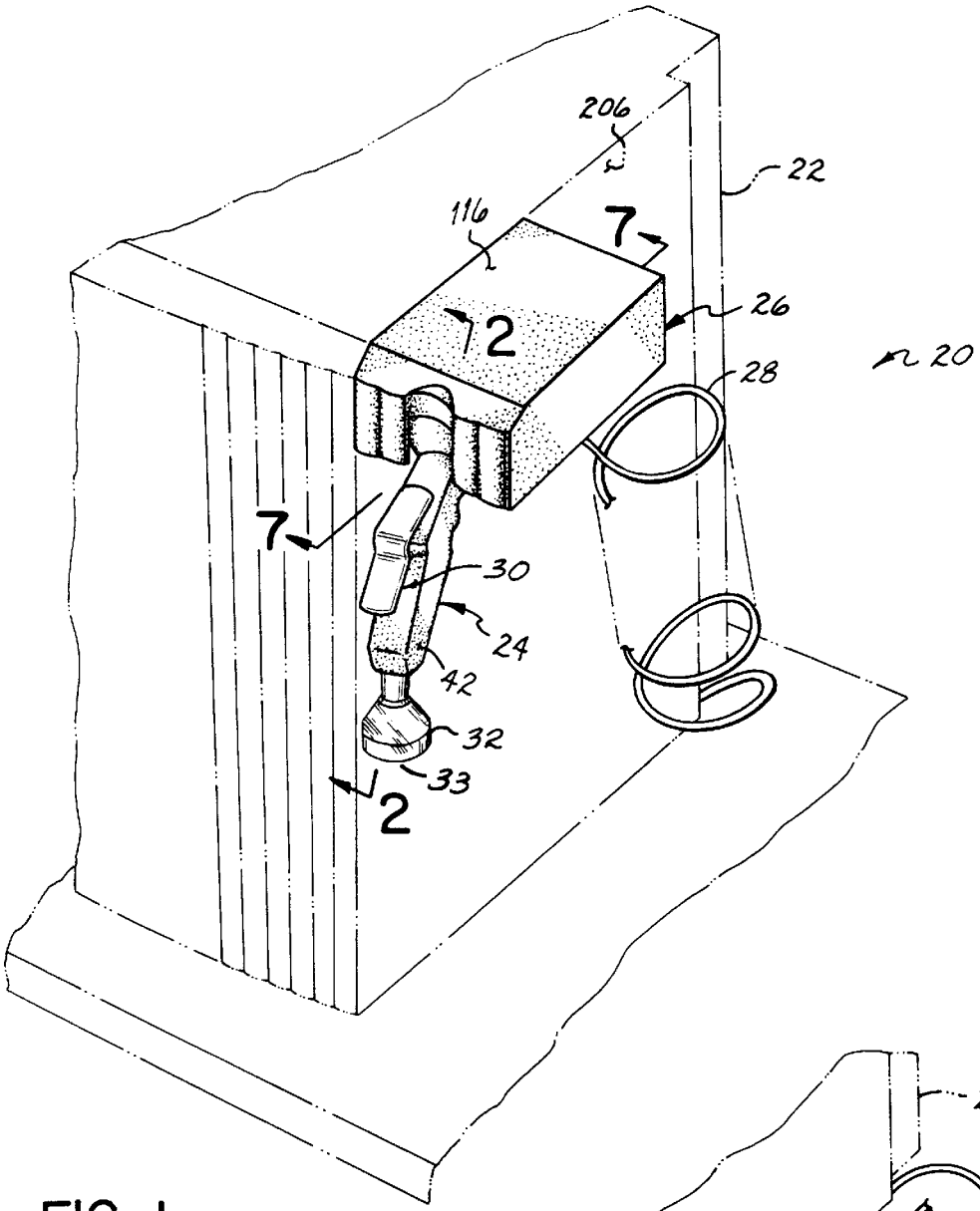
FIG. 1 is a perspective view of a bench top fluid supply and the fluid dispensing system functioning as a stationary fluid dispenser in accordance with the principles of the present invention.

Referring to FIG. 1 a dispensing system 20 is attached to a reservoir or source of fluid 22, for example, a water purifier such as a "NANOPURE" water purifier commercially available from Barnstead|Thermolyne of Dubuque, Iowa. Such a water purifier is described in U.S. patent application Ser. No. 081799,146, entitled "Water Purifier", filed on Feb. 14, 1997, and owned by the assignee of the present patent application. The entire disclosure of U.S. patent application Ser. No. 08/799,146 is hereby incorporated herein by reference. The dispensing system 20 includes a dispenser 24 releasably locked within a dispenser mount or holder 26. Flexible tubing 28 provides a fluid path between the water purifier 22 and the dispenser 24. With the dispenser secured in the holder 26, fluid may be dispensed there from by simply depressing the trigger 30 on the dispenser 24. Upon depressing trigger 30, water is dispensed through a filter 32 having a pore size in the range of approximately 0.1 to 0.2 micron for eliminating submicron bacteria and removing particulates from the water as it is being dispensed. The filter 32 is located immediately prior to the point of use 33 to remove any bacteria particles prior to the water being dispensed. The liquid flow path at the point of use 33 flows in a generally vertically downward direction and has a centerline that is angled downward at approximately 30° with respect to a center line of a main body portion of the dispenser 24.

In addition to providing a fixed dispensing location as illustrated in FIG. 1, the flexible tubing 28, which may be up to 5 meters or more in length, permits the dispenser 24 to be unlocked and removed from its mount 26 to dispense fluid at locations remote from the water purifier 22 and mount 26. Thus, the dispensing system 20 is unique in that a single dispenser 24 has capability of dispensing fluid at both fixed and remote locations.

Figures 2, 4, 6, 13:
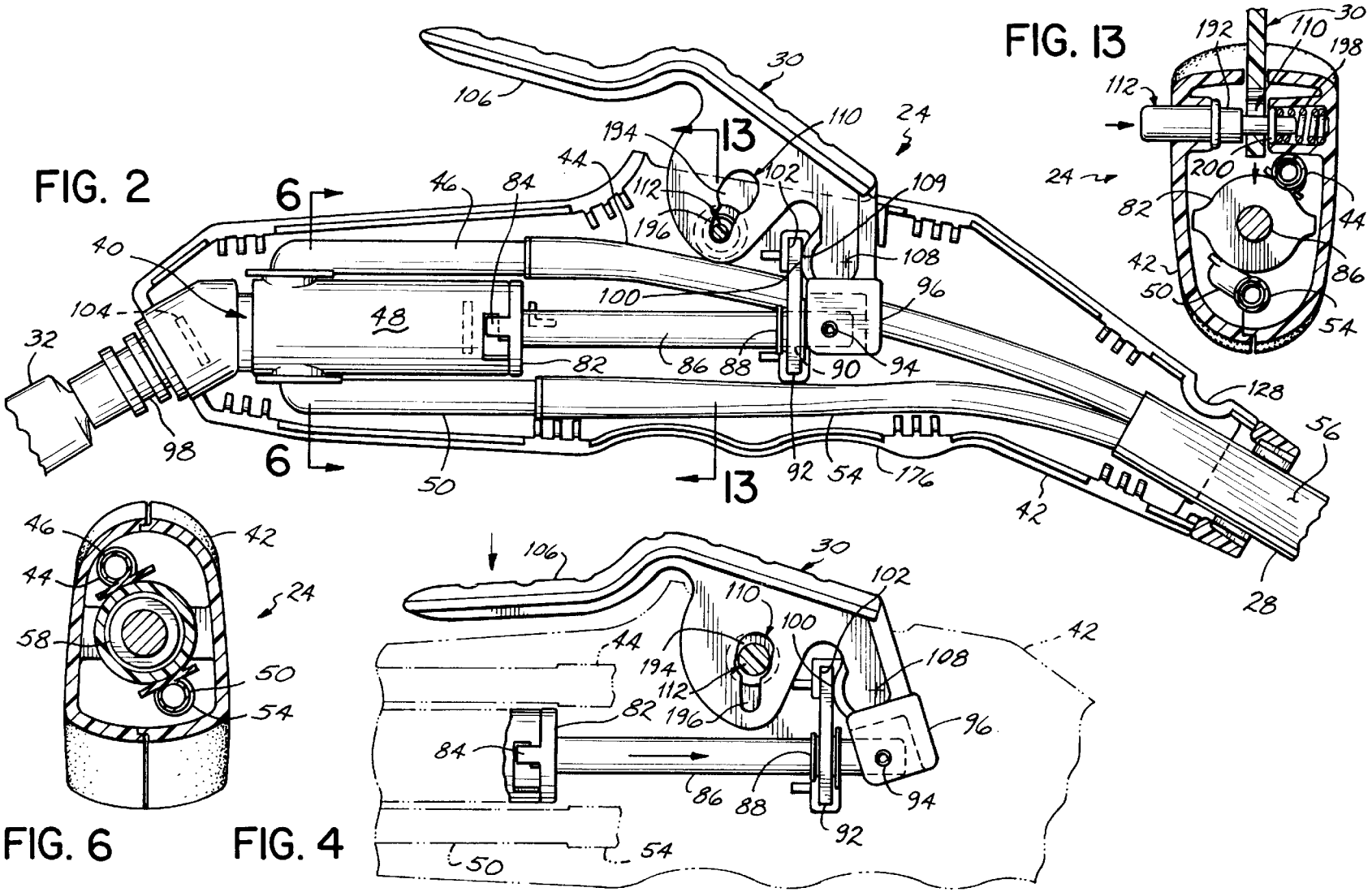
FIG. 2 is a cross-sectional view of the fluid dispenser taken along line 2—2 of FIG. 1.
FIG. 4 is a partial cross-sectional view of the fluid dispenser taken along line 2—2 of FIG. 1 and illustrating the trigger in its depressed position that functions to open the valve.
FIG. 6 is cross-sectional view of the fluid dispensing valve taken along line 6—6 of FIG. 2 and illustrating the orientation of the valve with respect to its housing.
FIG. 13 is cross-sectional view of the fluid dispensing valve taken along line 13—13 of FIG. 2 and illustrating the pushbutton trigger lock.
Figure 3:
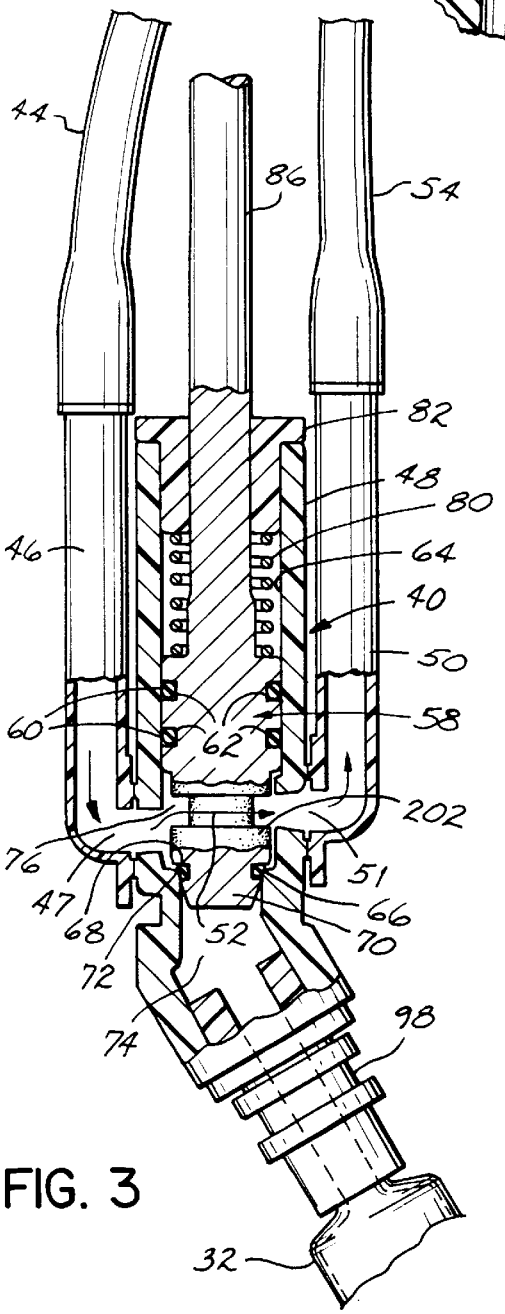
FIG. 3 is partial cross-sectional view of the fluid dispensing valve taken along line 2—2 of FIG. 1 and illustrating the valve in the closed nondispensing position.

Referring to FIGS. 2 and 3, a dispensing valve assembly 40 is housed within a casing 42. The casing is split into substantially identical left and right casing halves or members, and the casing 42 is shaped to provide a comfortable hand grip for the dispenser. The casing 42 is made from a "CYCOLAC" ABS material commercially available from General Electric of Schenectady, New York. The casing is opaque, and therefore, the potential degenerative effects of ultraviolet light on components inside the casing are prevented. The tubing 28 includes a flexible inlet tube 44 that has one end coupled to a fluid outlet port (not shown) of the purifier and another end connected by spin welding to a valve inlet tube 46. The valve inlet tube 46 is connected via a hot plate weld to an inlet port 47 of a cylindrical valve body 48. A valve recirculation tube 50 is connected by a hot plate weld to an outlet port 51 of the valve body 48 at a location substantially diametrically opposite from the outlet port 47. A fluid path 52 provides fluid communication between the inlet and outlet ports 47, 51, respectively, within the valve body 48. The valve recirculation tube 50 is connected by a spin weld to one end of a flexible recirculation tube 54 that has its other end coupled to a recirculation port (not shown) on the water purifier 22. The flexible tubing 44, 54, valve inlet and recirculation tubes 46, 50 and valve body 48 are made from "KYNAR" polyvinylidene fluoride material commercially available from Atochem of Philadelphia, Pennsylvania which does not leach into reagent water. The flexible tubing 44, 54 is encased within an opaque polyvinyl chloride ("PVC") material 56 which shields the fluid within the flexible tubes 44, 54 from exposure to ambient light. Thus the purity of the fluid within the flexible tubing 44, 54 is protected from the degenerative effects of UV light on the 46, 52 tubing.

Referring to FIG. 3, a generally cylindrical valve 58 is slidably mounted within the tubular valve body 48, so that the valve body 48 and valve 58 have concentric centerlines 59. O-rings 60, 61 are disposed in external annular grooves 62 on the valve 58 and are compressed against an inner cylindrical surface 64 of the valve body 48, thereby providing a fluid seal between the fluid passage 52 and the interior of the casing 42. An O-ring 66 is disposed in an external annular groove 68 in the valve tip portion 70 of the valve 58. The O-ring 66 bears against a valve seat 72 within the valve body 48, thereby providing a fluid seal between the internal passage 52 and the dispensing outlet 74. Inlet 47 and outlet 51 are as close to the valve seat 72 as possible. With the valve 58 in the illustrated closed position, fluid recirculates freely from the source 22, through the inlet tubes 44, 46, the valve body inlet 47, through fluid path 52 which includes an annular recirculation groove or cavity 76 in the valve 58, through the recirculation outlet 51 and through the outlet tubes 50, 54 back to the source 22. The above described recirculation fluid path has smooth surfaces throughout, and there are no sharp corners, blind passages, closed legs, or cavities contiguous with the fluid path that permit the fluid to accumulate and not flow. Thus, all of the fluid in the recirculation fluid path continuously flows therethrough, and fluid flow exists through all portions of the recirculation fluid path.

The construction features of placing the inlet 47, the outlet 51 and the valve seat 72 in close proximity and eliminating blind or closed paths is especially important when dispensing reagent water. Reagent water can experience contamination if allowed to stagnate in a closed passage. In addition, the minimal size design of fluid passage 52 also minimizes the total area of valve components wetted by, that is, exposed to the fluid. With reagent water, minimizing the wetted areas within the valve body 48, minimizes the potential for impurities to leach into the water. Generally, the wetted area in the valve is directly proportional to the time required to polish reagent water to the desired 18.17 megohm-cm. The O-rings 60, 66 are normally made of a "VITON" rubber elastomer commercially available from Parker Seal Co. of Culver City, Calif. The O-rings 60 may also be made from a "TEFLON" polytetrafluoroethylene material or another fluoro-containing polymer. The O-ring material experiences some leaching into reagent water. However, the valve 58 is constructed such that, when the valve 58 is in its closed and sealed position, exposure of the recirculating fluid to the O-rings 60 and 66 is minimal; and therefore, any leaching from the O-rings 60, 66 is also minimal.

The valve 58 is biased in its closed position against the valve seat 72 by a compression spring 80. A bushing or valve cap 82 is inserted into the end of the valve body 48 and locked into the valve body 48 by a bayonet-type coupling 84 which is quick and easy to assemble. When the cap 82 is in its locked position, it contacts and compresses the spring 80 to provide a desired, constant biasing force against the valve 58. The constant spring bias provides a consistent and reliable seal between the valve tip 70 and the valve seat 72. To hold the valve 58 in its illustrated closed position, a valve stem or shaft 86 forms an inner end of the valve 58. Referring to FIG. 2, the shaft 86 extends through a "NYLON" material sleeve bearing 88 that is inserted through hole 90 in a trigger bearing plate 92. The distal end of the valve stem 86 is pivotally connected by a pivot pin 94 to an inner end 96 of trigger 30. The trigger 30 includes a fulcrum cam surface 100 that bears against the trigger plate 92. The trigger plate 92 is secured within a slot 102 molded within the casing 42, and further, the valve body 48 is secured with respect to the casing 42 by tongue and slot components 104.

Figure 5:
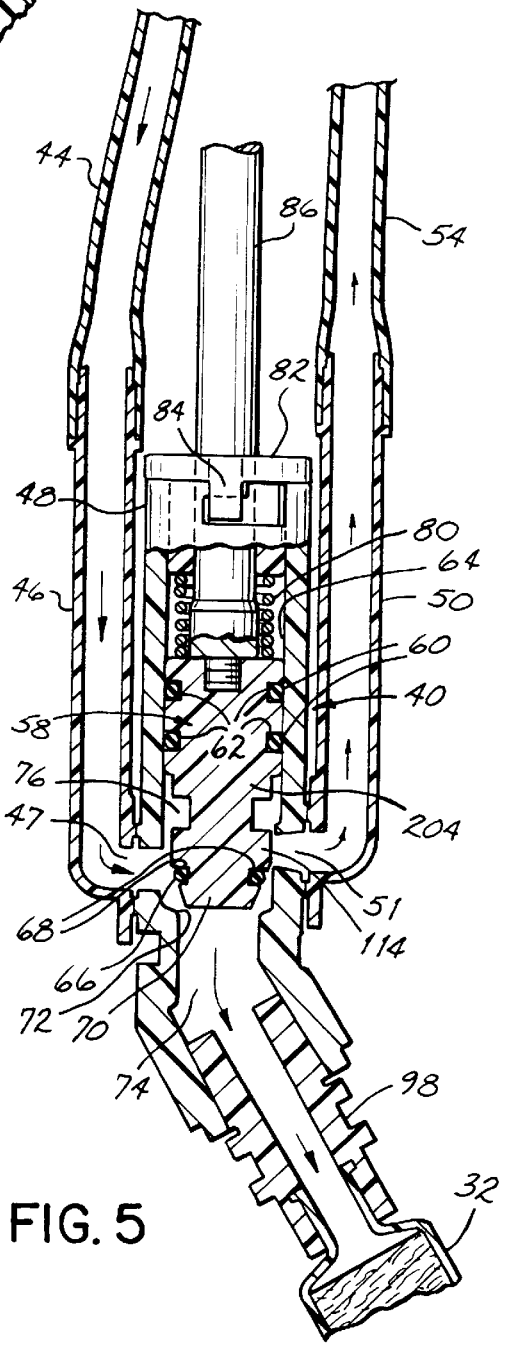
FIG. 5 is partial cross-sectional view of the fluid dispensing valve taken along line 2—2 of FIG. 1 and illustrating the valve in the open dispensing position.

Depressing the handle 106 in a direction toward the casing 42 causes the trigger 30 to rotate with respect to an axis 108 in a generally counterclockwise direction as viewed in FIG. 2. The axis of rotation 108 being determined by the cam 100 bearing against and pivoting with respect to surface 109 of the trigger plate 92. As the cam 100 rotates, it also slides slightly across the surface 109 towards the shaft 86; and the surface 109 may be treated with a low friction material such as either a polycarbonate, a "TEFLON" polytetrafluoroethylene material or another fluoro-containing polymer. As the handle 106 is depressed, slot 110 moves with respect to a pin 112; and the inner end 96 of the trigger 30 rotates counterclockwise and moves upward away from the trigger plate 92. The upward moving trigger end 96 pulls the valve stem 86, valve 58 and valve tip 70 away from the valve seat 72. With the handle 106 fully depressed as shown in FIG. 4, the valve 58 is in its fully opened position as illustrated in FIG. 5. As the valve tip 70 is retracted from the valve seat 72 by operation of the handle 106, the valve tip 70 partially closes the recirculation outlet 51 on the valve body 48. Thus, with the dispensing valve 40 open, fluid flows through the valve body inlet 47, through the fluid path 52, past the valve seat 72, through the dispenser outlet 74 and filter 32, thereby dispensing fluid from the dispenser 24. The dispenser outlet 74 includes a Luer fitting 98 made from a virgin polypropylene to which the filter 32 is coupled. The recirculation outlet 51 while approximately diametrically opposite from the valve inlet 47 is axially offset from the valve inlet 47. Therefore, as the valve tip 70 moves away from the valve seat 72, a land 114 formed adjacent the annular groove 76 moves over and substantially blocks fluid flow through the recirculation outlet 51. When the handle 106 is fully depressed and the dispensing valve 40 is fully open, approximately twenty percent (20%) of the fluid flow through the valve body inlet 47 will continue to recirculate through the recirculation outlet 51.

As the handle 106 is released, the spring 80 pushes the valve 58 forward toward the valve seat 72. That action causes the valve stem 86 to pull the end 96 of the trigger 30 toward the trigger plate 92. The trigger 30 rotates with respect to the axis 108 in a generally clockwise direction as viewed in FIG. 2. When the forward tip 70 of the valve 58 engages the valve seat 72, thereby closing the dispensing valve 40, the recirculation outlet 51 is again open; and a recirculation flow is reestablished as illustrated in FIG. 3. It should be noted that a center line of the fitting 98 and the dispensing flow from the point of use at the output of the filter 32 is angled at approximately 30° with respect to a center line of the valve 58 and the main portion of the valve body 48. As will subsequently be described, the angled dispensing outlet facilitates use of the dispenser 24. Further, as illustrated in FIG. 6, the inlet tube 46 and recirculation tube 50 are slightly rotated with respect to the main body of the dispensing tip 74 and valve body 48. That angled orientation of the tubes 46, 50 is provided to minimize the size of the casing 42.

Figure 7:
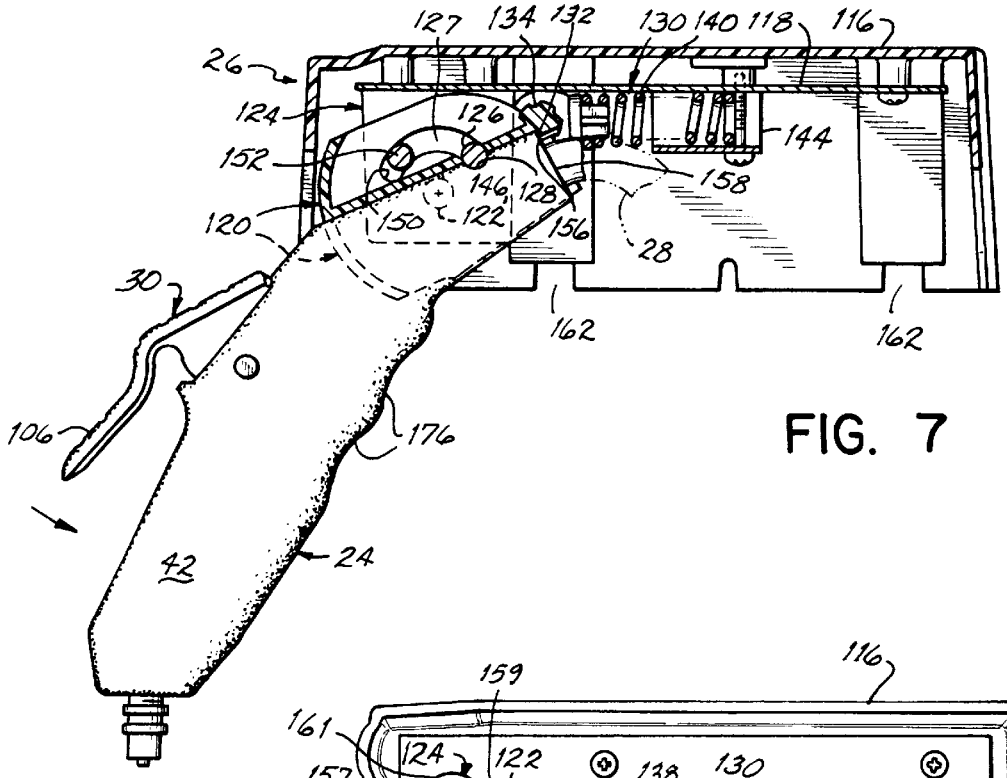
FIG. 7 is a partial cross-sectional view of the fluid dispenser holder taken generally along line 7—7 of FIG. 1 and illustrating the fluid dispenser locked in the holder.
Figure 8:
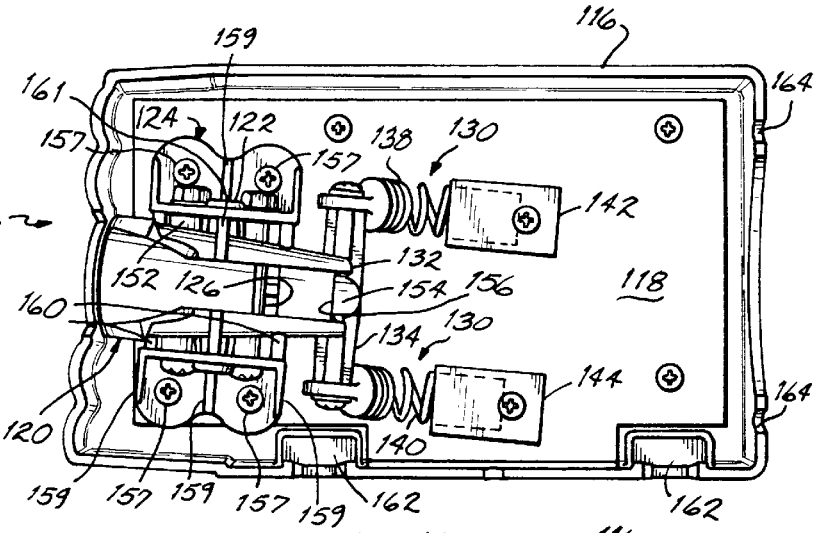
FIG. 8 is a bottom plan view of the fluid dispenser holder illustrating the components of the locking mechanism but without the dispenser engaged in the holder.

As illustrated in FIG. 1, the dispenser 24 is releasably locked within the mount 26 to provide a stationary dispensing location. Referring to FIGS. 7 and 8, the mount 26 includes a housing 116 to which a support plate 118 is attached. The dispenser 24 is supported within a holster or holder 120 that is rotatably mounted with respect to a pivot pin 122 supported at its ends by two mounting blocks 124. The holder 120 is shaped to receive and support the rear portion of the dispenser 24, and therefore, the rear portion of the dispenser can be easily slid into and out of the holder 120. The holder 120 is made from an injection molder polycarbonate material, for example, a 241 polycarbonate material commercially available from General Electric of Schnectedy, N.Y. which holds the dispenser 24 rigid therein. A locking pin 126 extends through slot 127 and is also supported at its ends by mounting blocks 124. In the locked position, the locking pin 126 is disposed within a slot 128 in the casing 42 of the dispenser 24. A toggle 130 mounted on the end 132 of the rotating holster 120 applies a biasing force against the end 132, thereby forcing the holster 120 and dispenser 24 firmly against the pin 126. Consequently, the dispenser 24 is restrained from moving out of the holster 120 and is locked in a stationary dispensing position in the mount 26.

Toggle mechanism 130 includes a toggle arm 134 rigidly connected to the end 132 of the holster 120. The toggle arm 134 extends in the direction generally perpendicular to a longitudinal axis of the holster 120. The ends of the toggle arm 134 are connected to the ends of respective toggle springs 138, 140. The other ends of the toggle springs 138, 140 are secured to the support plate 118 by respective brackets 142, 144. Therefore, when the toggle is in the over center upper position shown in FIG. 7, the springs 138, 140 apply forces against the ends of the toggle arm 134, thereby pushing the end 132 of the holster 120 in a generally counterclockwise direction as viewed in FIG. 7 until the pin 128 engages the first end 146 of the slot 127. It should be noted that when the dispenser is inserted into the holster 120, the first end 146 of the slot 127 is generally concentric and contiguous with the locking slot 128 in the casing 42 of the dispenser 24.

Figure 9:
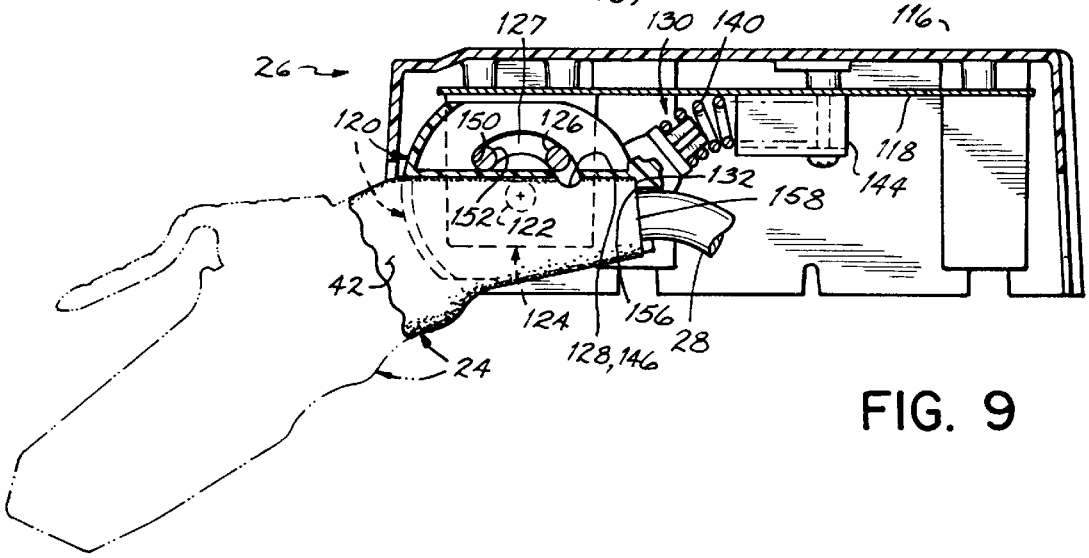
FIG. 9 is a partial cross-sectional view of the fluid dispenser holder taken along line 7—7 of FIG. 1 and illustrating the fluid dispenser in an unlocked release position in the holder.

When it is desired to use the dispenser 24 at a remote location, the dispenser 24 is rotated in a generally clockwise direction as illustrated in FIG. 7. The dispenser 24, holster 120 and toggle arm 134 rotate clockwise and compress the springs 138, 140. As rotation of the dispenser 24 continues, the compression of the springs 138, 140 increases until the springs 138, 140 achieve a maximum compression which defines the toggle point of the toggle 130. Continued rotation of the dispenser 24 in the clockwise direction causes the toggle 130 to toggle over in the downward direction, thereby applying a spring force against the end 132 of the holster 120 and pushing the holster 120 in the clockwise direction. That clockwise rotation continues until the second stop end 150 of the slot 127 engages the stop pin 152, as illustrated in FIG. 9. The stop pin 154 also extends through the slot 127 and is supported at its ends by mounting blocks 124. The springs 138, 140 are effective to maintain a biasing force against the toggle arm 134 to hold the holster 120 firmly against the stop pin 152. When in the position illustrated in FIG. 9, the locking pin 126 is disengaged from the locking slot 128 in the casing 42 of the dispenser 24, thereby unlocking the dispenser and permitting it to be easily and freely removed from the holster 120.

After using the dispenser 24 at remote locations, when it is desired to return dispenser 24 to its fixed location, the end of the dispenser 24 containing the locking slot 128 is inserted into the holster 120. The holster includes an opening 154 which provides clearance for the tubing 28 as the dispenser 24 is inserted into the holster 120. In addition, the holster has an end stop 156 that engages the end surface 158 of the dispenser 24, so that the dispenser 24 does not wedge within the holster 120. After the dispenser 24 is fully inserted into the holster, it is rotated counterclockwise, thereby rotating the slot 127 with respect to the pins 126, 152. When the rotation of the holster 120 reaches the toggle point, the toggle 130 provides a biasing force to move the holster in the counterclockwise direction and push the locking slot 128 and first stop end 146 firmly against the locking pin 126, thereby locking the dispenser into the mount 26 as shown in FIG. 7.

The mounting blocks 124 are firmly secured to the support plate 118 by fasteners 157. Each of the blocks 124 further includes ribs 159 which prevent the block from bending or twisting. In addition, the holster 120 also includes two ribs 160 on each side to prevent the holder from twisting during its manipulation and operation, thereby maintaining the holster square with respect to the pivot pin 122. In addition, the holder 120 has a pivot boss and integral support rib 161 through which the pivot pin extends and which further contribute to the smooth and reliable operation of the holder 120. The housing 116 further includes slots 162 that are shaped to receive mating projections (not shown) on the water purifier 22 illustrated in FIG. 1, thereby permitting the mount 26 to be attached to the water purifier 22. For alternative mounting, the housing 116 further includes the slots 164 that permit the housing to be separately mounted on a vertical surface such as a wall.

Figure 10:
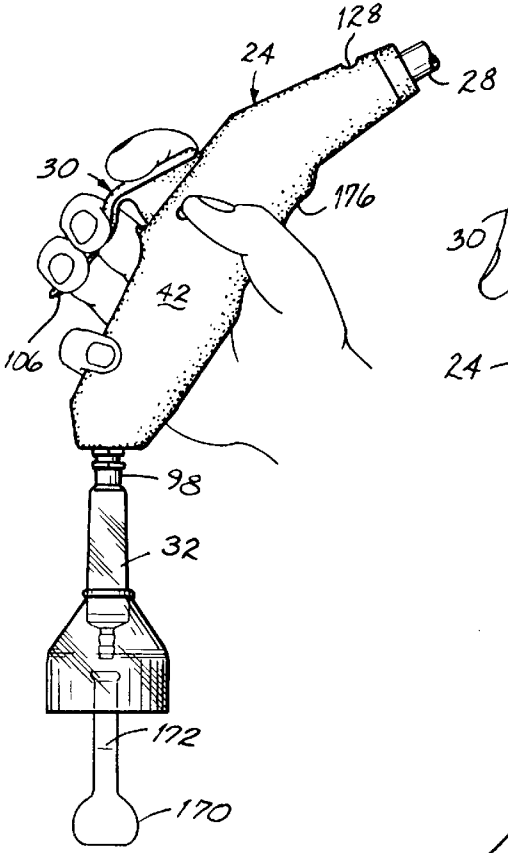
FIG. 10 is an elevational view of the fluid dispenser as it may be used remote from the holder and operated with the fingers for dispensing fluid into a container having an elevated position.

In use, the dispenser 24 is shaped to be gripped in several different ways depending on the location of the flask to be filled relative to the user. For example, referring to FIG. 10, many times it is desirable to dispense fluid from the dispenser 24 into a flask 170 by holding the dispenser 24 and flask 170 directly in front of the user such that the user may readily observe graduations 172 on the flask 170. In that situation, it is generally most comfortable for the user to hold the dispenser 24 with the palm of their hand facing generally upward and their fingers wrapped around the trigger 30. The dispenser outlet 74 is offset by approximately 30° from the general longitudinal axis of the dispenser 24. Therefore, when the dispenser is gripped as shown in FIG.

10 with the users wrist held generally straight, the dispenser outlet 74 and final filter 32 extend generally vertically downward, so that the flask 172 may be filled in a vertical orientation without the user having to bend their wrist in an awkward position. The casing 42 of the dispenser 24 includes a series of scalloped shapes 176 that further enhance the comfort and grip of the user on the dispenser 24.

Figure 11:
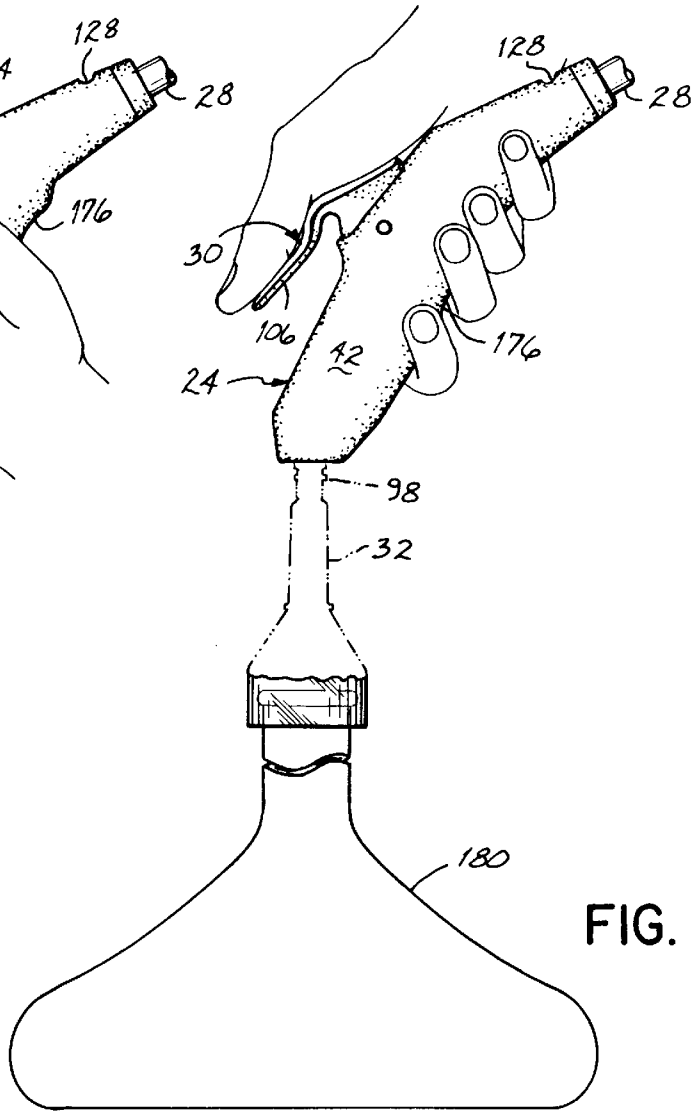
FIG. 11 is an elevational view of the fluid dispenser as it may be used remote from the holder and operated with a thumb for dispensing fluid into a container having a lower position.

In other applications as shown in FIG. 11, it may be desirable to fill a flask 180 that is located on a table top, bench surface or the floor. In that application; the dispenser 24 is held in a generally lower position; and the dispenser 24 is shaped such that the user can grip the dispenser with a thumb on the trigger 30 pointing toward the outlet 74 and their fingers wrapped around the lower side of the dispenser 24. Again, the scallops 176 provide a more comfortable and firm grip on the dispenser. Further, the angle of the dispensing outlet 74 permits the fluid to be dispensed in a generally vertical direction without the user having to cock or bend their wrist.

Figure 12:
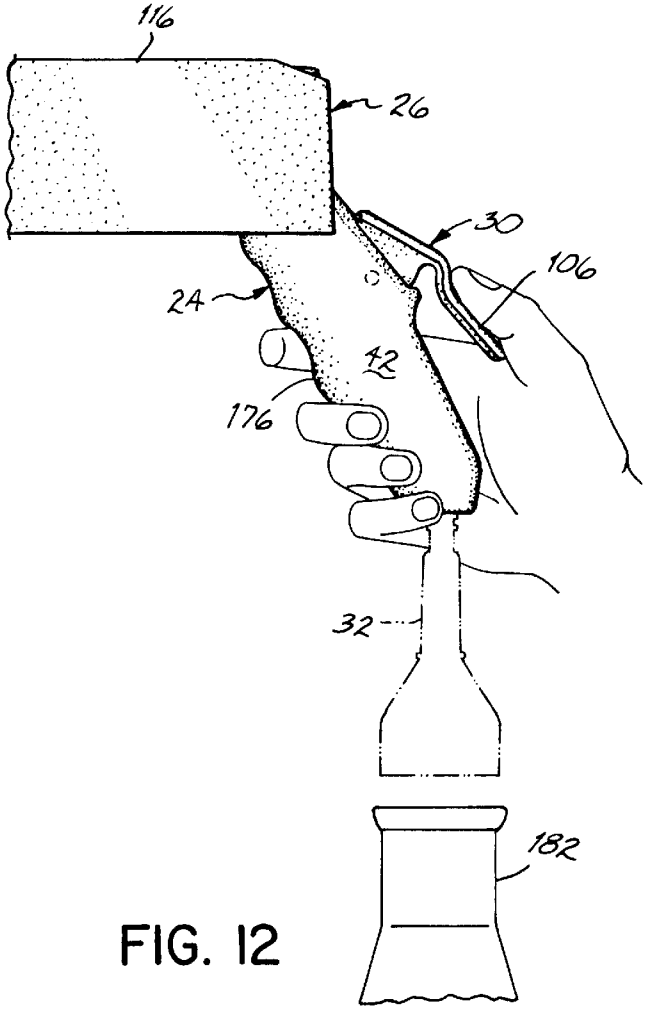
FIG. 12 is an elevational view of the fluid dispenser as it may be used in a stationary position, that is, locked in its holder.

When as shown in FIG. 12, fluid is to be dispensed from a fixed location, the dispenser 24 is locked into the mount 26. The dispenser 24 is moved from a remote location to a position forward of the holder 26, and the tubing 28 is aligned with the opening 154. The dispenser 24 is then moved into a supporting position within the holder 120 (FIG. 9), and thereafter, the dispenser 24 and holder 120 are moved to the locked position (FIG. 7). The dispenser 24 is designed to be easily gripped by a user's hand with the thumb on the trigger 30 pointing away from outlet 74, and the fingers wrapped around the scalloped areas 176 on the bottom of the dispenser. As with the other dispensing applications, the angle of the dispenser 24 with respect to the mount 26 permits the dispenser 24 to be gripped with the users wrist in a relatively straight orientation, and the angle of the dispensing outlet 74 permits fluid to be dispensed in a vertically downward direction into a flask 182.

Referring to FIGS. 2 and 13, any time the trigger 30 is depressed, a trigger locking pin 112 may be pushed which moves a larger diameter 192 of the pin 112 through larger end 194 of the slot 110 in the body of the trigger 30. If the trigger 30 is then released while still holding the pin 112 depressed, the larger diameter 192 of the pin 112 is larger than the diameter of the smaller end 196 of slot 110. Therefore, the depressed pin 112 locks the trigger 30 in its depressed position. With the trigger 30 locked in its depressed position, the valve 58 is maintained open, and fluid is continuously dispensed from the dispenser 24. If the trigger 30 is again depressed without pushing on locking pin 112, a spring 198 applies a force against the flange 200 and moves the pin 112 outward, thereby disengaging the diameter 192 from the larger slot end 194 in the body of trigger 30. That unlocks the trigger 30; and upon it being released, the trigger 30 returns to its quiescent position and the valve 58 closes, thereby terminating fluid flow from the dispenser outlet 74.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, referring to FIG. 3, the valve 58, including the valve tip 70 and shaft 86 is made from a 303 stainless steel. However, to make the valve 58 suitable for use with reagent water, the lower portion of the valve body 58 that extends below the spring 80 is normally coated with a "TEFLON" polytetrafluoroethylene material 202 or another fluoro-containing polymer. While such a construction performs satisfactory, FIG. 5 illustrates an alternative construction. In FIG. 5, the valve body 58 has an upper portion comprised of a shaft 86 normally made from a 303 stainless steel, which is threadedly engaged with a lower valve portion 204. The lower valve portion 204 is manufactured from a "TEFLON" polytetrafluoroethylene material or another fluoro-containing polymer, and the O-rings 60, 66 are used to provide the fluid seals. As will be appreciated, in reagent water applications, the O-rings may leach impurities into the reagent water.

Figure 15:
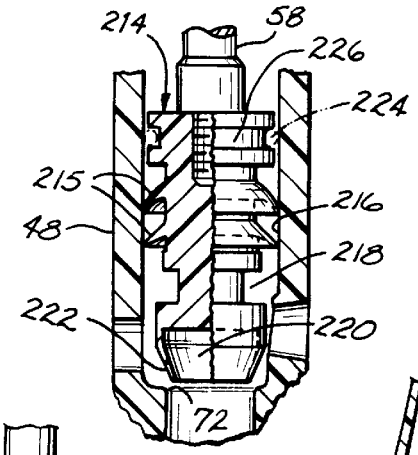
FIG. 15 is a partially broken away elevational view of a another embodiment of the valve illustrated in FIGS. 3 and 5.

FIG. 15 illustrates a further alternative construction of the valve 58 in which O-rings are not used. Again, the valve body 58 has an upper portion comprised of a shaft 86 normally made from a 303 stainless steel, which is threadedly engaged with one end of a cylindrical lower valve component 214. The lower valve component 214 is manufactured from a "TEFLON" polytetrafluoroethylene material or another fluoro-containing polymer, and the lower component 214 is shaped to inherently provide the necessary fluid seals. One or more ribs 215 extend radially from the component 214 toward the valve seat 72. The function of the ribs 215 is to maintain the valve component 212 substantially coaxial within the valve body 48, and to sealingly engage the inner cylindrical wall 216 of the valve body 48, thereby preventing fluid from leaking from the valve body 48. The lower component 214 also has an annular groove 218 providing a recirculation fluid path between the inlet 47 and the recirculation outlet 51. Adjacent the groove 218 is a land that partially covers the recirculation outlet 51 when the valve 58 is open and removed from the valve seat 72. The distal end of the lower component 214 has an axial bore 220 extending into the component 214 to form a resilient flexible annular member 222. The resilient member 222 has an annular external surface that sealingly engages the valve seat 72, thereby closing the valve assembly formed by the valve 58 and the valve seat 72 and terminating the flow of fluid through the dispensing outlet 74. If necessary, an O-ring 224 shown in phantom may located in groove 226 to provide an additional sealing capability. The O-ring 224 being located above the ribs 215 has little or no exposure to the fluid and does not present a leaching issue in reagent water applications.

In the valve designs described herein, the tubing, O-rings, valve body and valve all have wetted surfaces, that is, surfaces in contact with the reagent water. While various materials have been identified in association with those various components, any other materials may be used that have the similar property of either not leaching or leaching in acceptably small quantities into the reagent water. Further, when dispensing different fluids which have different characteristics, still different materials may be more suitable. Thus, the material chosen is a function of the fluid application in which the dispensing system is used.

Figure 14:
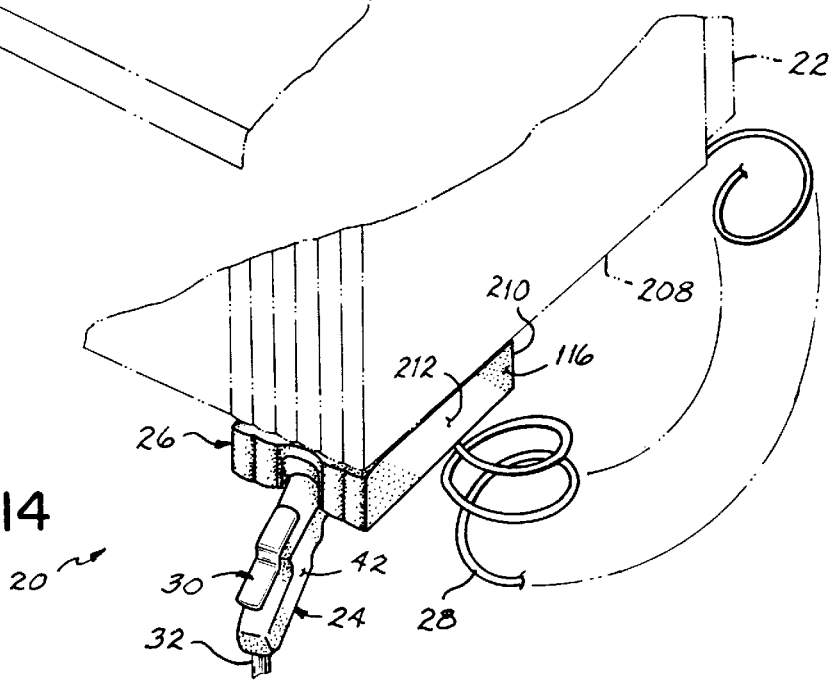
FIG. 14 is a fragmentary perspective view of a wall mounted fluid supply in combination with the fluid dispensing system of FIG. 1.

The dispensing system 20 is very flexible in its application. For example, as illustrated in FIG. 1, the housing 116 of the dispensing system 20 may be attached to a side housing surface 206 of the fluid supply 22. Alternatively, as illustrated in FIG. 14, the housing 116 of the dispensing system 20 may be attached to a lower housing surface 208 of the fluid supply 22. Further, in other applications, the housing 116 may be attached to any other vertical surface, for example, a wall of a room, the side of a cabinet, etc. Further, either a rear surface 210 or a side surface 212 can bear against the vertical mounting surface. While the source of fluid supply 22 has been described as a water purifier, the dispensing system 20 may be connected to any source of liquid. Further, the dispensing system 20 may be retrofitted to existing liquid supplies that have other dispensing devices associated therewith.

Therefore, the invention in its broadest aspects is not limited to the specific details shown and described. Consequently, departures may be made from the details described herein without departing from the spirit and scope of the claims which follow.

What is claimed is:

1. A manually operable fluid dispensing system comprising:

a source of fluid;

a dispenser having a manually operable dispensing valve;

flexible tubing connected between the source of fluid and the dispenser for providing a supply fluid path from the source of fluid to the dispenser and a recirculation fluid path from the dispenser to the source of fluid; and a dispenser mount adapted to be attached to a support surface, the dispenser mount supporting the dispenser to facilitate the dispenser dispensing fluid while being supported by the dispenser mount, and the dispenser being removable from the dispenser mount for dispensing fluid at a location remote from the dispenser mount.

2. The dispensing system of claim 1 wherein the dispenser has a forward portion from which fluid is dispensed and a rear portion, the dispenser mount includes a holder for supporting a rear portion of the dispenser to facilitate dispensing fluid from the forward portion while the dispenser is mounted in the holder.

3. The dispensing system of claim 2 wherein the holder is movably supported in the mount to facilitate selectively removing the dispenser from and, locking the dispenser in the holder.

4. The dispensing system of claim 3 wherein the holder is movable between a first position locking the dispenser in the holder and a second position permitting the dispenser to be removed from the holder.

5. The dispensing system of claim 4 wherein the holder includes a toggle for selectively biasing the holder in the first and the second positions, thereby maintaining the holder in the selected first and second positions.

6. The dispensing system of claim 5 wherein the holder includes a curved slot having a stationary first pin mounted through the slot such that the slot and the holder supporting the dispenser pivot with respect to the first pin, thereby providing a pivoting motion between the first and second positions.

7. The dispensing system of claim 6 wherein the pin engages one end of the slot to limit motion of the holder in rotating the holder and dispenser supported therein to the first position.

8. The dispensing system of claim 7 wherein the dispenser includes a locking slot contiguous and generally concentric with the one end of the slot when the holder and dispenser supported therein are at the first position, and the pin simultaneously engages the one end of the slot and the locking slot when the holder and dispenser are at the first position, thereby locking the dispenser in the holder.

9. The dispensing system of claim 1 wherein the support surface is a generally vertical surface on the source of fluid.

10. The dispensing system of claim 1 wherein the support surface is a generally horizontal surface on the source of fluid.

11. A method of dispensing fluid using a dispenser connected to a source of fluid by flexible tubing, the method comprising the steps of:

attaching a dispenser mount to a surface;

supporting the dispenser in the dispenser mount;

operating the dispenser supported in the dispenser mount to dispense fluid from the fluid source;

removing the dispenser from the dispenser mount;

moving the dispenser to a remote location displaced from the dispenser mount; and operating the dispenser at the remote location to dispense fluid from the fluid source, whereby a single dispenser is used to dispense fluid selectively from a fixed location and a remote location.

12. The method of claim 11 wherein the step of attaching the dispenser mount to a surface further comprises the step of attaching the dispenser mount to a housing surface for the source of fluid.

13. The method of claim 11 wherein the step of supporting the dispenser in the dispenser mount further comprises the steps of:

moving the dispenser to an insertion position with respect to the dispenser mount; and moving the dispenser to a supporting position with respect to the dispenser mount.

14. The method of claim 11 wherein the step of supporting the dispenser in the dispenser mount further comprises the steps of:

inserting the dispenser in the dispenser mount; and securing the dispenser in the dispenser mount.

15. The method of claim 11 wherein the step of operating the dispenser further comprises the step of moving a trigger extending in a generally longitudinal direction with respect to the dispenser.

16. A manually operable fluid dispensing system comprising:

a source of fluid;

a dispenser having a manually operable dispensing valve with a valve body including a fluid inlet, a fluid dispensing outlet at one end of the valve body, a valve seat between the inlet and the dispensing outlet, and a fluid recirculation outlet, a valve slidably mounted within the valve body and including a valve fluid recirculation path providing fluid communication between the inlet and the recirculation outlet, a valve tip engageable with the valve seat to provide a fluid seal, the valve tip being selectively movable to a first position sealingly engaging the valve seat and the valve fluid recirculation path providing a fluid passage between the inlet and the recirculation outlet, and the valve tip being selectively movable to a second position away from the valve seat to provide a fluid path from the inlet to the dispensing outlet and the valve tip in the second position partially covering the recirculation outlet to inhibit the flow of fluid therethrough;

flexible tubing connected between the source of fluid and the dispenser for providing a supply fluid path from the source of fluid to the dispenser inlet and a recirculation fluid path from the dispenser recirculation outlet to the source of fluid; and a dispenser mount adapted to be attached to a support surface, the dispenser mount supporting the dispenser to facilitate the dispenser dispensing fluid while being supported by the dispenser mount, and the dispenser being removable from the dispenser mount for dispensing fluid at a location remote from the dispenser mount.

17. The dispensing valve of claim 16 wherein the valve seat is immediately adjacent the inlet.

18. The dispensing valve of claim 17 wherein the recirculation outlet is axially displaced from the inlet toward an opposite end of the valve body.

19. The dispensing valve of claim 18 wherein the recirculation outlet is circumferentially displaced from the inlet.

20. The dispensing valve of claim 19 wherein the recirculation outlet is circumferentially displaced from the inlet by approximately 180°.

21. The dispensing valve of claim 19 wherein the recirculation fluid path is an external cavity in the valve.

22. The dispensing valve of claim 21 wherein the external cavity is an annular groove.

23. The dispensing valve of claim 22 wherein the valve includes a land that partially covers the recirculation outlet when the valve in is the second position.

24. The dispensing valve of claim 23 wherein land is formed adjacent the annular groove.

25. The dispensing valve of claim 16 wherein the valve is made from a metallic material coated with a fluoro-containing polymer and includes a seal on the valve tip to sealingly engage the valve seat.

26. The dispensing valve of claim 16 wherein the valve includes a first portion made from a metallic material; and a second portion attached to the first portion and made from a solid fluoro-containing polymer, the second portion including a seal on the valve tip to sealingly engage the valve seat.

27. The dispensing valve of claim 26 wherein the seal is an O-ring seal mounted in the second portion.

28. The dispensing valve of claim 16 wherein the seal is a resilient member made from a fluoro-containing polymer at one end of the second portion.

29. The dispensing valve of claim 16 wherein the dispensing outlet has a centerline forming an included angle of approximately 30° with a centerline of the valve body.

30. The dispensing valve of claim 16 further comprising a filter connected to the dispensing outlet for eliminating bacteria and removing particulates from the water dispensed from the dispensing system.

31. The dispensing valve of claim 30 wherein the filter has a pore size not exceeding 0.2 microns.

32. A manually operable fluid dispensing system of claim 16 wherein the valve further comprises a valve seal at one end formed by a resilient member made of a material from the fluoro-containing polymer and engageable with the valve seat to provide a fluid seal therebetween.

33. A manually operable fluid dispensing system comprising:

a source of fluid;

a dispenser having a manually operable dispensing valve with a valve body including a fluid dispensing outlet at one end of the valve body, a fluid inlet, a valve seat between the fluid inlet and the dispensing outlet, the valve seat being located immediately adjacent the fluid inlet, a fluid recirculation outlet, a valve slidably mounted within the valve body and including a valve fluid recirculation path providing fluid communication between the inlet and the recirculation outlet, and a valve tip selectively engageable with the valve seat to provide a fluid seal;

flexible tubing connected between the source of fluid and the dispenser for providing a supply fluid path from the source of fluid to the dispenser inlet and a recirculation fluid path from the dispenser recirculation outlet to the source of fluid, wherein the flexible tubing, the fluid inlet, the valve fluid recirculation path and the fluid recirculation outlet provide a flow path in which all fluid in the flow path is continuously moving; and a dispenser mount adapted to be attached to a support surface, the dispenser mount supporting the dispenser to facilitate the dispenser dispensing fluid while being supported by the dispenser mount, and the dispenser being removable from the dispenser mount for dispensing fluid at a location remote from the dispenser mount.

34. The dispensing valve of claim 33 wherein the first and second tubing is made from a polyvinylidene fluoride material and the valve is made of a fluoro-containing polymer.

35. A manually operable fluid dispensing system comprising:

a source of fluid;

a dispenser having a manually operable dispensing valve with a valve body including a fluid inlet, a fluid dispensing outlet at one end of the valve body, a valve seat between the inlet and the dispensing outlet, a valve slidably mounted within the valve body and including a valve tip on one end of the valve sealingly engageable with the valve seat to provide a fluid seal therebetween, a stationary bearing plate having a planar surface at approximately a right angle with the centerline of the valve body, and a trigger having one end pivotally connected to an opposite end of the valve, an arcuate cam surface contacting the planar surface, and a handle extending toward the one end of the valve body, the handle being movable in a direction toward the centerline, whereby the cam surface pivots and slides on the bearing surface and the valve moves away from the valve seat, thereby opening the valve;

flexible tubing connected between the source of fluid and the dispenser for providing a supply fluid path from the source of fluid to the dispenser inlet and a recirculation fluid path from the dispenser to the source of fluid; and a dispenser mount adapted to be attached to a support surface, the dispenser mount supporting the dispenser to facilitate the dispenser dispensing fluid while being supported by the dispenser mount, and the dispenser being removable from the dispenser mount for dispensing fluid at a location remote from the dispenser mount.

36. The dispensing valve of claim 35 wherein the valve includes a shaft extending from an opposite end of the valve and the trigger is pivotally connected to the shaft.

37. The dispensing valve of claim 36 wherein the bearing plate includes a hole through which the shaft extends.

38. The dispensing valve of claim 35 further including a resilient spring for biasing the handle of the trigger in a direction opposite the centerline and causing the valve to move toward the valve seat, thereby closing the valve.

39. The dispensing valve of claim 35 further comprising a releasable lock operative coupled to the trigger for selectively holding the trigger in a position maintaining the valve open.

40. A manually operable fluid dispensing system comprising:

a generally elongated dispenser body having a centerline; and a manually operated dispensing valve adapted to be connected to a source of fluid and mounted within the dispenser body, the valve providing a fluid flow at a point of use having a center line intersecting the centerline of the dispenser body to form an included angle of approximately 30°.

41. A manually operable fluid dispensing system comprising:

a generally elongated dispenser body having a forward surface connecting forward common edges of two lateral sides and a lower side;

a dispensing valve adapted to the connected to a source of fluid and mounted within the dispenser body with a dispensing outlet extending through one end of the dispenser body, the dispensing outlet angling downward toward the lower side;

a manually operable trigger pivotally connected to the dispensing valve and having a quiescent position closing the dispensing valve, and when in the quiescent position, the trigger having a handle extending over an exterior portion of the dispenser body in a generally forward direction toward the dispensing outlet and forming an included angle with the dispenser body, the trigger being movable toward the dispenser body to open the dispensing valve and permit fluid to flow through the dispensing outlet; and a spring operably connected to the trigger for biasing the handle toward the quiescent position.

42. The fluid dispensing system of claim 41 wherein the body further comprises:

two substantially parallel flat sides;

a lower side joining common lower edges of the two sides and curving outward from the center; and an upper surface joining common upper edges of the two sides.

43. The fluid dispensing system of claim 42 wherein the two sides taper towards the bottom.

* * * * *